US006865832B1

(12) United States Patent
Goldman

(10) Patent No.: US 6,865,832 B1
(45) Date of Patent: Mar. 15, 2005

(54) HANGER WITH INFORMATION TAB

(75) Inventor: Allan J. Goldman, Wayne, NJ (US)

(73) Assignee: Uniplast Industries, Inc., Hasbrouck Heights, NJ (US)

( * ) Notice: Subject to any disclaimer, the term of this patent is extended or adjusted under 35 U.S.C. 154(b) by 0 days.

(21) Appl. No.: 10/655,646

(22) Filed: Sep. 4, 2003

(51) Int. Cl.[7] ..... A47G 25/14
(52) U.S. Cl. ..... 40/322; 223/85
(58) Field of Search ..... 40/322; 223/85, 223/92

(56) References Cited

U.S. PATENT DOCUMENTS

| | | | |
|---|---|---|---|
| 970,529 | A | 9/1910 | Miller |
| 1,099,261 | A | 6/1914 | Lewyt |
| 1,142,720 | A | 6/1915 | McAuley |
| 1,321,926 | A | 11/1919 | Landry |
| 1,348,952 | A | 8/1920 | Landry |
| 1,389,266 | A | 8/1921 | Newton |
| 1,710,296 | A | 4/1929 | Clark |
| 1,738,724 | A | 12/1929 | Perleth et al. |
| 2,166,492 | A | 7/1939 | Harvey |
| 2,690,863 | A | 10/1954 | Adelman |
| 2,801,036 | A | 7/1957 | Klein |
| 3,024,953 | A | 3/1962 | O'Keefe |
| D192,845 | A | 5/1962 | Cohen |
| 3,535,808 | A | 10/1970 | Morrish |
| D229,810 | A | 1/1974 | Wahl |
| D235,639 | A | 7/1975 | Cohen |
| 3,898,754 | A | 8/1975 | Johansson |
| 3,949,914 | A | 4/1976 | Ostroll |
| 4,006,547 | A | 2/1977 | Samuels et al. |
| 4,017,990 | A | 4/1977 | Garrison |
| D244,197 | A | 5/1977 | Ostroll |
| D245,748 | A | 9/1977 | Ostroll |
| 4,045,899 | A | 9/1977 | Richardson |
| 4,101,059 | A | 7/1978 | Batts et al. |
| D249,619 | A | 9/1978 | Wolff |
| 4,115,940 | A | 9/1978 | Phillips |
| 4,123,864 | A | 11/1978 | Batts et al. |
| 4,137,661 | A | 2/1979 | Johansson |
| 4,160,333 | A | 7/1979 | Indelicato |
| 4,198,773 | A | 4/1980 | Batts et al. |
| 4,322,902 | A | 4/1982 | Lenthall |
| D264,912 | A | 6/1982 | Bliss et al. |
| 4,333,590 | A | 6/1982 | Princiotta |
| 4,450,639 | A | 5/1984 | Duester |
| D282,982 | A | 3/1986 | Kodet |
| 4,630,385 | A | 12/1986 | Swim |
| 4,679,340 | A | 7/1987 | Johansson |
| 4,756,104 | A | 7/1988 | Bailey |

(Continued)

*Primary Examiner*—Cassandra Davis
(74) *Attorney, Agent, or Firm*—Darby & Darby

(57) ABSTRACT

According to one exemplary embodiment, an information clip is provided and it not only resiliently engages a securing ridge adjacent a free edge of the clip holder, but in addition, is provided with a platform on which leading edges of the clip sit on when the clip is securely attached to the clip holder. The platform is part of a stepped construction formed as part of the clip holder and the platform has a rear edge that acts to inhibit access to the leading edges of the clip when the clip is securely attached to the clip holder. In one embodiment, an upper surface of the platform includes surface modifying features that are formed therein to assist in locating and retaining the leading clip edges along the upper surface of the platform.

23 Claims, 4 Drawing Sheets

U.S. PATENT DOCUMENTS 4,982,519 A 1/1991 Hans
4,997,114 A 3/1991 Petrou
5,096,101 A 3/1992 Norman et al.
5,199,608 A 4/1993 Zuckerman
5,238,159 A 8/1993 Zuckerman
5,383,583 A 1/1995 Zuckerman
5,407,109 A 4/1995 Zuckerman
5,441,182 A 8/1995 Sullivan
5,469,995 A 11/1995 Bredeweg et al.
5,485,943 A 1/1996 Zuckerman
5,590,822 A 1/1997 Zuckerman
5,613,629 A 3/1997 Zuckerman
5,683,018 A 11/1997 Sullivan et al.
5,819,995 A 10/1998 Zuckerman
6,019,260 A * 2/2000 Gouldson ..... 223/85
6,041,983 A 3/2000 Sullivan et al.
6,145,713 A 11/2000 Zuckerman

* cited by examiner

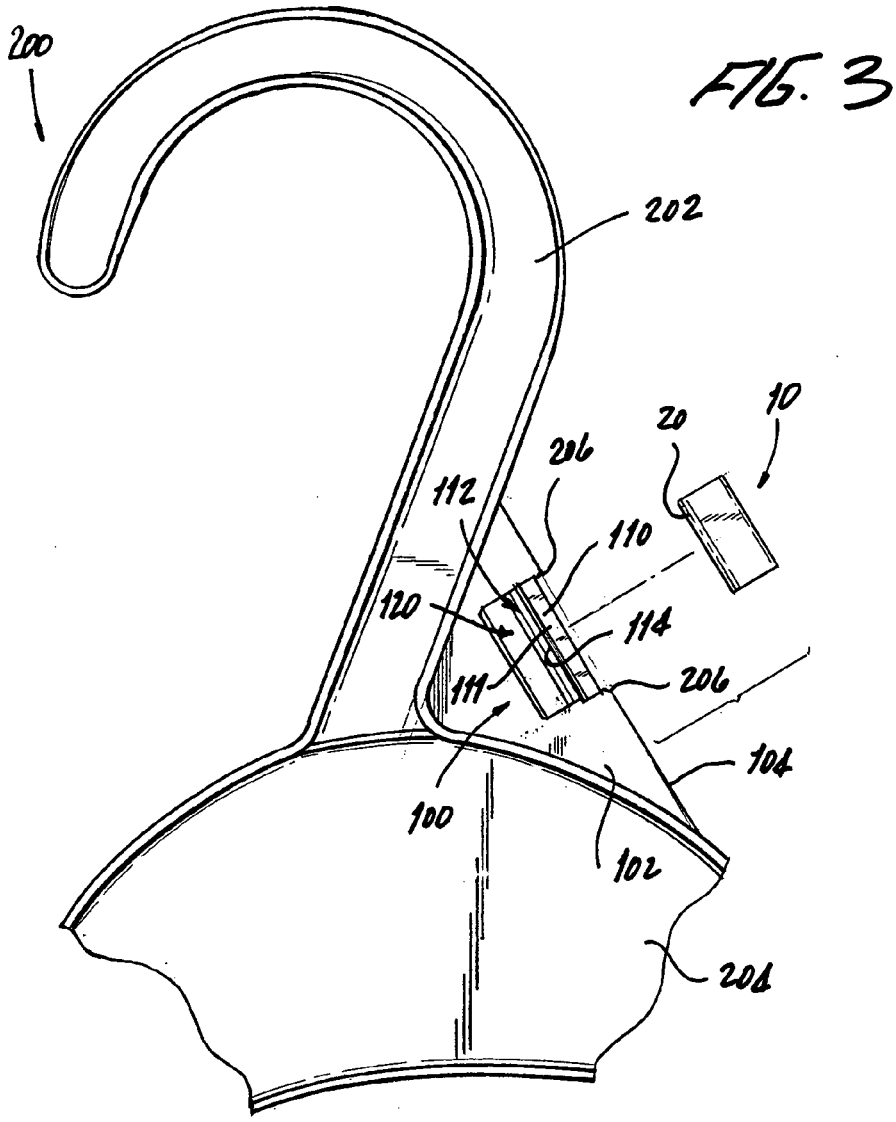
FIG. 3
FIG. 4
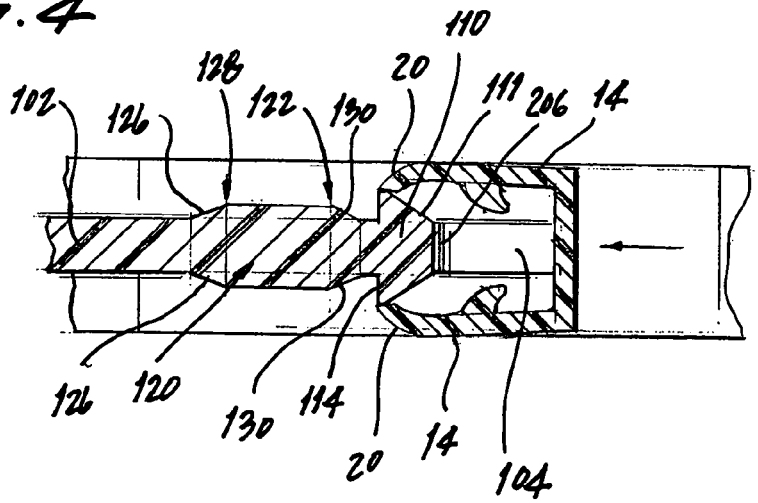

HANGER WITH INFORMATION TAB

TECHNICAL FIELD

The present invention relates to a garment hanger of the type which includes a locking information clip and more particularly, to a garment hanger adapted to receive such a locking information clip so that its removal is prevented.

BACKGROUND

Garment information clips have been previously known and used. U.S. Pat. No. 4,115,940, for example, discloses a molded plastic garment hanger which includes a web-like clip-mounting member which exposes a single edge onto which an information clip can be secured. The information clip of the hanger disclosed in U.S. Pat. No. 4,115,940 is intended to be easily removably and therefore, the hanger offers no element or feature to prevent or discourage information clip removal. Such easily removable information clips are satisfactory for some applications; however, in view of the small size of the clips, which can be readily swallowed, and with increased concerns about child safety, especially when such garment hangers are taken home with a purchased product, it becomes important to provide a garment hanger which prevents the accidental removal of a secured information clips. In addition, where such clips can provide price information, it is desirable to prevent intentional removal, to minimize possible fraudulent interchange of clips.

There are a number of hangers that have been developed to have lockable information clips. For example, U.S. Pat. Nos. 5,096,101 and 5,199,608 both disclose garment hangers having lockable information clips. The garment hangers disclosed in these two patents include elements which discourage, but do not prevent, removal of a secured information clip. In this design, the information clip can be removed from the securing ridge of the clip holder by pulling the side walls apart with respect to one another, against the inherent resiliency urging them to the relaxed position, sufficiently for each respective locking finger to clear a respective portion of the securing ridge. This prior art structure discourage, but does not prevent removal of the information clip by somewhat inhibiting access to the lower edges (foremost edges) of the side walls of the clip, by means of a concealing ridge.

Accordingly, it is an object of the present invention to provide a garment hanger adapted to receive an information clip and both discourage and prevent its accidental and/or intentional removal from the hanger.

SUMMARY

According to one exemplary embodiment, an information clip is provided and it not only resiliently engages a securing ridge adjacent a free edge of the clip holder, but in addition, is provided with a platform on which leading edges of the clip sit on when the clip is securely attached to the clip holder. The platform is part of a stepped construction formed as part of the clip holder and the platform has a rear edge that acts to inhibit access to the leading edges of the clip when the clip is securely attached to the clip holder. In one embodiment, an upper surface of the platform includes surface modifying features that are formed therein to assist in locating and retaining the leading clip edges along the upper surface of the platform. In yet another embodiment, obstruction members are provided along the ends of the platform to inhibit side access to the leading edges of the clip. These obstruction members can be in the form of posts or the like which are formed alongside the ends of the platform and preferably are forward at or near the rear edge of the platform.

Other features and advantages of the present invention will be apparent from the following detailed description when read in conjunction with the accompanying drawings.

BRIEF DESCRIPTION OF THE DRAWING FIGURES

The foregoing and other features of the present invention will be more readily apparent from the following detailed description and drawings figures of illustrative embodiments of the invention in which:

FIG. 3 is a perspective view of the clip holder of FIG. 1 with the clip being exploded therefrom;

Figure 1:
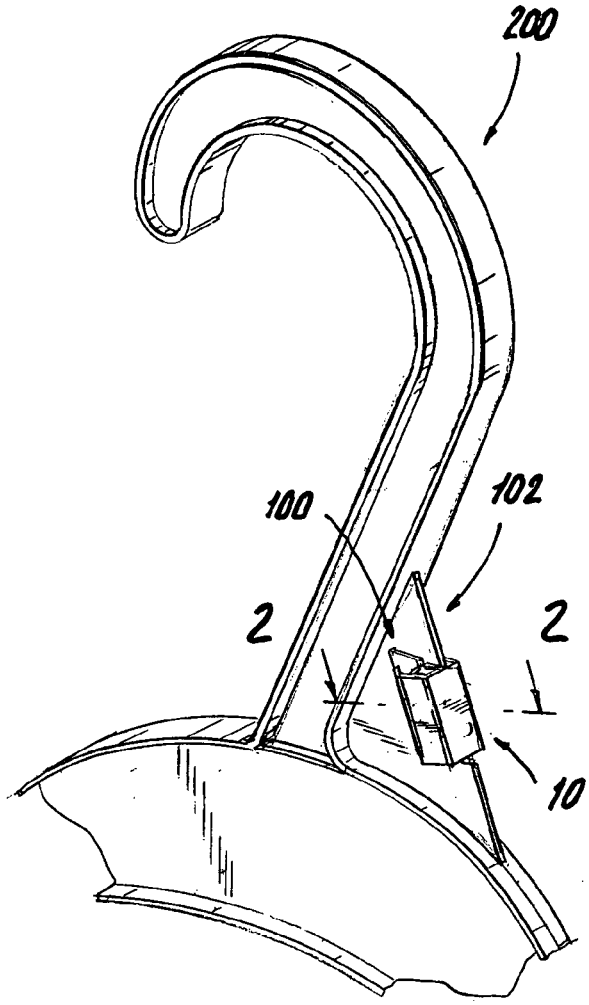
FIG. 1 is a perspective view of a garment hanger having a clip holder and a clip in a locked position in accordance with a first embodiment.
Figure 4A:
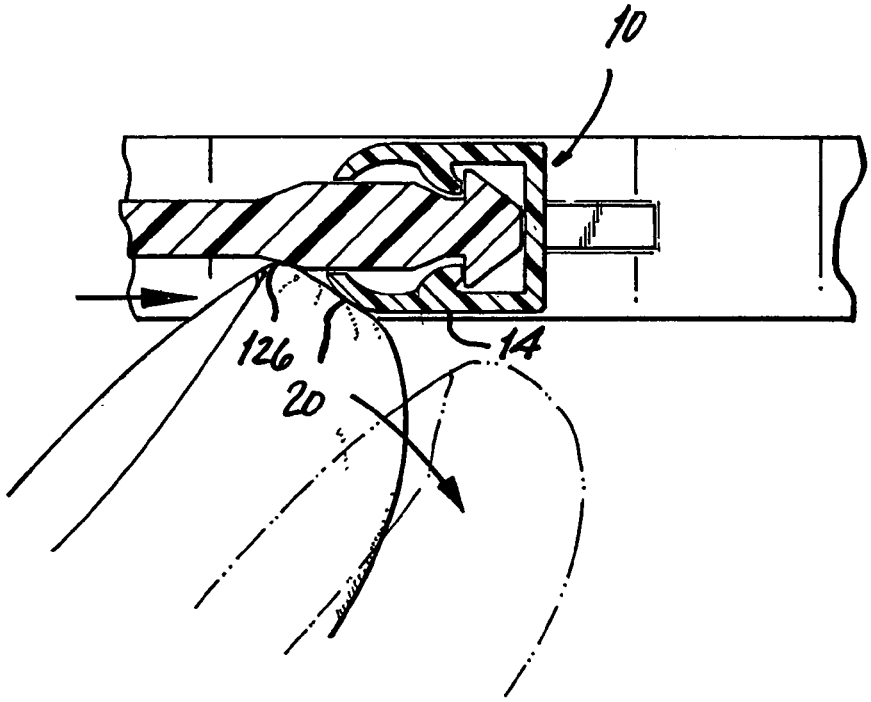
FIG. 4 is a partial cross-sectional view of the clip holder and a clip being in a partially open position as the clip is inserted onto the clip holder.
Figure 4B:
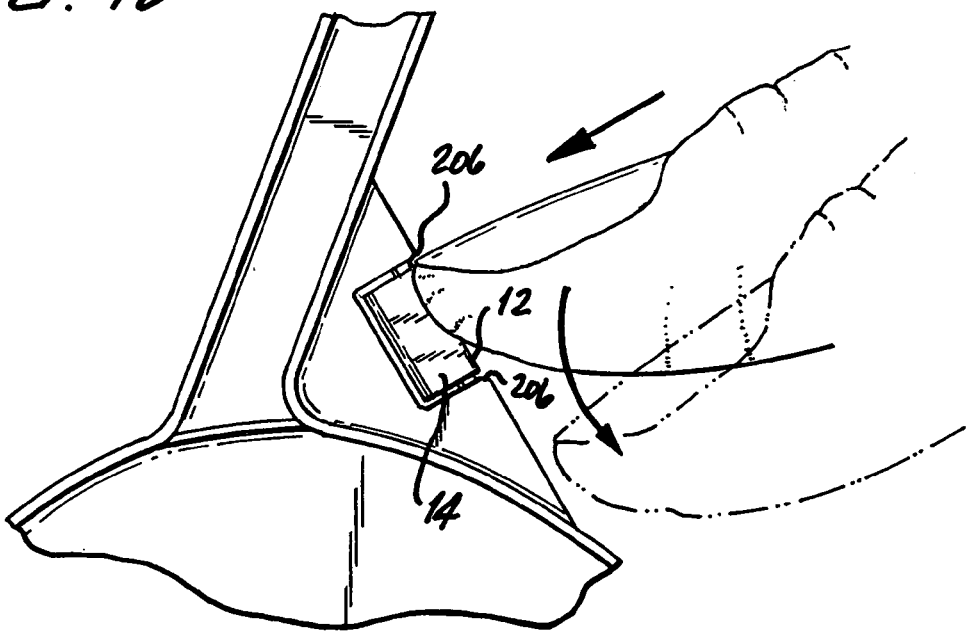
Figure 5:
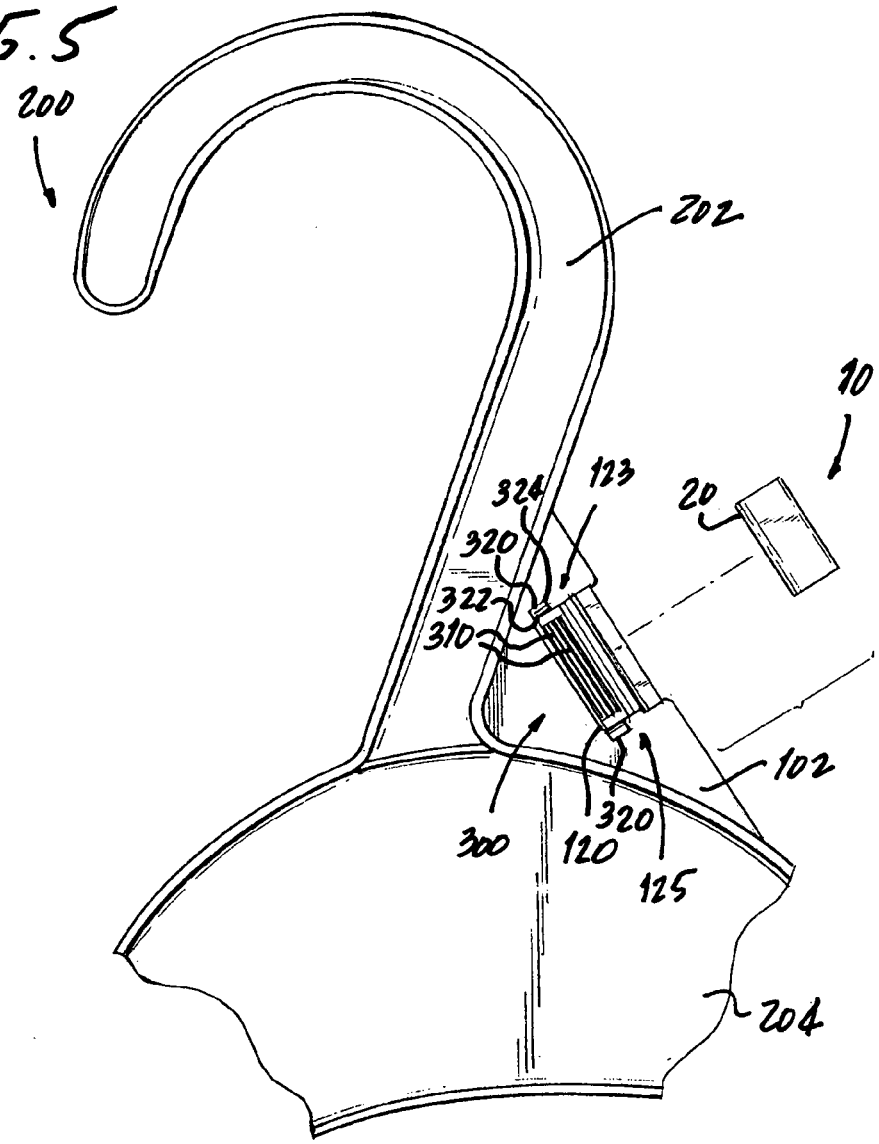
Figure 6:
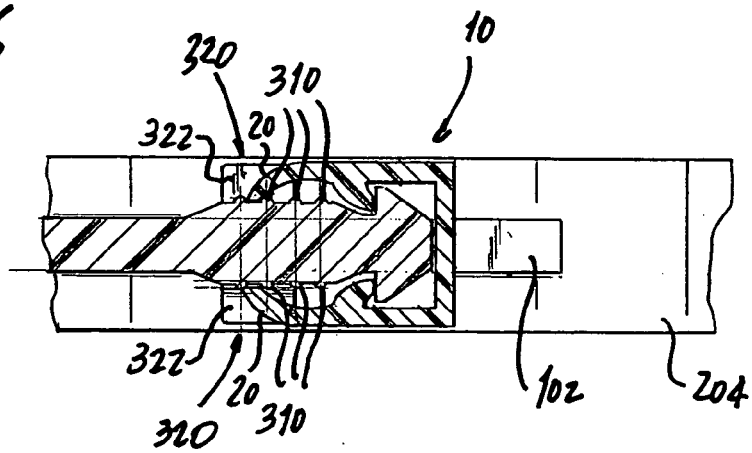

FIG. 4*a* is a partial cross-sectional view of the clip holder and clip of FIG. 1 with the clip being in a locked position showing how access to the foremost edges of the clip is inhibited;

FIG. 4*b* is a top plan view of the clip holder and clip of FIG. 1 showing how side access to a closed end of the clip is inhibited;

FIG. 5 is a partial top plan view of a clip holder according to a second embodiment; and FIG. 6 is a partial cross-sectional view of a clip holder and clip of FIG. 5 in a locked position.

DETAILED DESCRIPTION OF PREFERRED EMBODIMENTS

FIGS. 1-4*c* illustrate an information clip 10 mated to an information clip holder 100 according to a first embodiment and which forms an integral part of hanger 200.

The information clip 10 is a conventional information clip and includes a front surface 12, two opposing side walls 14, inner locking projections 16, an insertion channel 18 and foremost edges 20 of the side walls 14. In the relaxed state of the clip 10, the projections 16 thereof are desirably separated by a distance no greater than a thickness of the clip holder web 102 so as to enhance the engagement of projections 16 with the complementary locking feature formed as part of the clip holder 100. The foremost edges 20 are slightly curled inward and the projections 16 are angled relative to the side walls 14. Preferably, the projections 16 are not normal to the side walls 14 but are formed at some other angle. The information clip 10 can be manufactured by a conventional extrusion process using an appropriate plastic, such as PVC or nylon. The information clip 10 is further preferably made to have a natural resiliency so that the side walls 14 can be flexed, or otherwise deformed, but will naturally return to a relaxed position.

The hanger 200 of FIG. 1 includes the clip holder 100 formed on a central web 102. The clip holder is shown in cross-section in FIGS. 2 and 4. The central web 102 includes a leading free edge 104 that extends between a hook 202 and a body section 204 of the hanger 200. As will be described in more detail hereinafter, the clip holder 100 is recessed relative to the leading free edge 104 such that a pair of shoulders 206 are formed between a leading section of the clip holder 100 and the free edge 104. In other words, there is a notch formed in the free edge 104 where the clip holder 100 is located.

Figure 2:
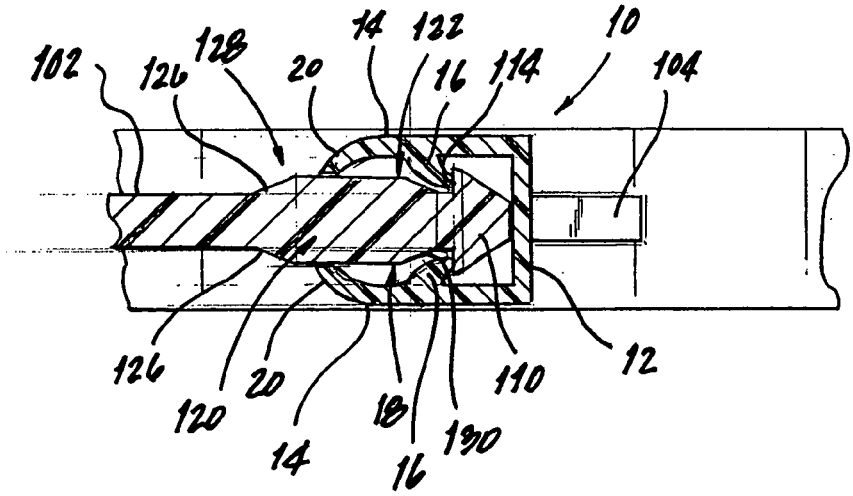
FIG. 2 is a partial cross-sectional view of the clip and holder of FIG. 1 in the locked position, taken along the line 2—2 of FIG. 1.

The clip holder 100 includes a front locking or securing ridge 110. The cross-sectional shape of the front locking ridge 110 is preferably a truncated triangular shape, as shown in FIG. 2. At a rear section 112 of the front locking ridge 110, the ridge 110 defines a shoulder 114 with the web 102 and more particularly, the shoulder 114 is preferably formed at a right angle. The clip holder 100 has a raised platform 120 formed as a part thereof on which the foremost edges 20 of the clip 10 rest when the clip 10 is securely fastened to the clip holder 100. The platform 120 is raised relative to the web 102; however, the height of the platform 120 is not as great as a height of the front locking ridge 110. The raised platform 120 preferably includes a planar section on which the curled foremost edges 20 sit when secured to the clip holder 100.

As can be best seen in the cross-sectional view of FIG. 2, there is a slight ramp 130 between the rearmost part (shoulder 114) of the first locking ridge 110 and the raised platform 120. More specifically, the ramp 130 is an inclined surface that extends from the bottom of the shoulder 114 to a forward end 122 of the platform 120. The angle defined between the surface of the ramp 130 and the surface of the web 102 is relatively slight, such as an angle on the order of about 10-15 degrees, e.g., about 11 degrees relative to the web. However, one will appreciate that the ramp 130 can be formed at any number of other angles relative to the web 102 and therefore, the above mentioned angles are only exemplary and not limiting of the present invention. Thus, the ramp 130 itself has a relatively slight incline and instead marks a gradual, slight transition from the first locking ridge 110 to the raised platform 120. The width of the ramp 130, as defined from the bottom of shoulder 114 to forward end 122 of the platform 120, is relatively slight compared to the widths of the surrounding elements. For example, the width of the ramp 130 can be from about 0.050 inches to about 0.1 inches, e.g., 0.075 inches. In comparison, the first locking ridge 110 can have a width from about 0.050 to about 0.1 inches, e.g., 0.063 inches, and the platform can have a width from about 0.10 inches to about 0.20 inches, e.g., 0.17 inches.

At a rear end 128, the platform 120 has an edge (wall) 126 that extends between the platform 120 and the web 102. The edge 126 can be a beveled edge or it can be a vertical edge (perpendicular to the web 102) that defines a second shoulder. The height of the edge 126 is thus approximately about the height of the ramp 130 so that the top planar surface of the platform 120 is preferably parallel to the web 102.

The space between the ramp 130 and the rear of the front locking ridge 110 is an area where one projection 16 of the clip 10 is received in a releasably interlocking manner so as to lock the information clip 10 to the clip holder 100. Thus, the shape and dimension of the projection 16 is preferably complementary to the shape and dimension of this space defined by the ramp 130 and the front locking ridge 110.

The width of the platform 120 is preferably about the same as or substantially the same as the width of the front locking ridge 110. Thus, the ends of the front locking ridge 110 and the ends of the platform 120 are axially aligned with one another.

The distance between the foremost leading edges 20 of the side walls 14 is preferably greater than or close to the thickness of the front locking edge 110 so that the clip 10 can be easily pushed onto the clip holder 100 past the front locking edge 110. At this point, the clip 10 can easily be forced into the locked position by pushing the leading edges 20 up a forward side 111 of the front locking edge 110, thereby separating further the leading edges 20 until the leading edges 20 clear the front locking ridge 100 and then drop onto the ramp 130 before being advanced up the ramp 130 and onto the platform 120. As the clip 10 is continued to be advanced inward from the leading edge 104 of the web 102, the leading edges 20 travel along the platform 120, while the projections 16 ride up the forward side 111 of the front locking ridge 110, thereby resulting in the sides 14 of the clip 10 being further separated. Once the projections 16 clear the front locking ridge 110, the projections 16 snap into place within the space between the platform 120 and the front locking ridge 110 due to the resilient nature of the clip 10. In other words, each projection 16 snaps into place and seats on a corresponding ramp 130. The projections 16 and the front locking ridge 110 are angled in opposite directions (i.e., the front locking ridge 110 is angled away from the leading free edge 104 of the web 102 and the projections 16 are angled toward the free edge 104) and therefore, once each projection 16 seats on one ramp 130 against the front locking ridge 110, the clip 10 cannot be simply removed by pulling the clip 10 in a direction toward the free edge 104 since the front locking ridge 110 provides interference due to the teeth like mating between projections 16 and the front locking ridge 110.

The clip 10 is preferably sized so that when the projections 16 interlockingly engage the front locking ridge 110, the leading edges 20 are received on the platform 120 (plateau) when the clip 10 is pushed into its fully locked position, as shown in FIG. 2. The width of the platform 120 is such that when the clip 10 is securely locked in place, the leading edges 20 seat on the platform 120 with a predetermined amount of the rear end 124 of the platform 120 being exposed. The precise amount of the platform 120 that is exposed will vary depending upon the width of the platform 120 and the actual size of the clip 10. Preferably, the leading edges 20 do not extend over the innermost section of the platform 120 but rather the leading edges 20 seat on the platform 120 at or near the edge 126.

Although when the clip 10 is in its locked position its leading edges 20 are technically accessible to a person's fingernail and therefore can be grasped and pried apart, it has been discovered by the applicant that it is very difficult for a person to acquire his/her fingernail beneath the leading edge 20 of a locked clip 10 as shown in FIG. 4*a*. This is because as the fingernail slides along the central web 102, in a forward direction, and rides up the rear side to the platform 120, the fingernail has a tendency to "jump" over the otherwise accessible leading edge and continue along the outer surface of the side wall 14 of the clip 10, failing to engage the leading edge 20. The harder the person slides his/her fingernail across the web 102, the more pronounced the "jump" and the more difficult the clip 10 becomes to remove.

Yet another safety feature is the notched construction of the leading free edge 104 such that when the clip 10 is locked in place on the clip holder 100, the front surface 12 of the clip 10 lies within the notch. The formation of the notch, defined between the shoulders 206, discourages or prevents a user from getting his/her fingernail underneath the front surface 12 of the clip 10 in an effort to pry the clip 10 from the clip holder 100. Thus, the notch serves as a safety feature that discourages or prevents the removal of the clip 10 by somewhat inhibiting access to ends of the front surface 12 as best shown in FIG. 4*b*.

Accordingly, the front surface 12 of the clip 10 can be relatively planar with the leading free edge 104. By having the front surface 12 relatively flush with the free edge 104, the clip 10 does not extend or protrude beyond the free edge 104 where it would be more susceptible to being dislodged from the clip holder 100. The width of the notch is equal to or preferably slightly greater than a width of the clip 10; however, there should not be an excessive amount of space between each end of the front surface 12 and one respective shoulder 206 that defines one end of the notch.

Now referring to FIGS. 5 and 6 in which a clip holder 300 according to a second embodiment is illustrated. The clip holder 300 is similar to the clip holder 100 of FIGS. 1-4; however, the clip holder 300 has the following additional features not present in the clip holder 100. For sake of brevity, the common features between the two clip holders 100, 300 are not described in detail with respect to the discussion of the clip holder 300 but instead like drawing reference numbers denote like elements.

The clip holder 300 includes several additional retaining and safety features. More specifically, the clip holder 300 includes a plurality of ribs 310 formed on an upper surface of the platform 120 where the leading edge 20 of the clip 10 rests. The ribs 310 are slightly raised elements that are preferably formed in a plurality of rows that are parallel to the front locking ridge 110. The height of the ribs 310 is variable but in most instances, the height is very small since the purpose of the ribs 310 is to further grip, locate and retain the leading edges 20 of the clip 10. The ribs 310 therefore are merely features that roughen the surface of the platform 120.

Each illustrated rib 310 extends the entire or substantially the entire width of the platform 120; however, it will be understood that each rib 310 can be formed in two distinct segments, axially aligned with one another, that are formed near the ends of the platform 120. The number of ribs 310 and the location thereof can be varied depending upon a number of factors, including the size of the platform 120 and the clip 10 and the dimensions of the ribs 310. In one embodiment, the ribs 310 are evenly spaced from one another and generally extend from the most forward section of the platform 120 to the most rear section of the platform 120. However, in an alternative embodiment, the ribs 310 do not extend completely across the platform 120 but rather the ribs 310 are formed only on one section of the platform 120, e.g., the ribs 310 are formed in an area that is one half the area of the platform 120. For example, the ribs 310 can be formed in the forward half of the platform 120.

The ribs 310 function to grip and retain the leading edges 20 of the clip 10 in the following manner so that motion of the clip 10, namely the leading edges 20 thereof, is restricted when the clip 10 is engaged with the clip holder 300. Since the leading edges 20 can be constructed so that they can be received between two adjacent ribs 310, the ribs 310 serve to locate the leading edges 20 and restrict the ease at which the leading edges 20 can slide across the platform 120. In other words, the play between the clip 10 and the clip holder 300 can be further reduced by the placement of the ribs 310 on the clip holder 300 since the clip 10 has a tendency not to rock as much or be movable across the platform 120 when the leading edges 20 are positioned between adjacent ribs 310. It will thus be appreciated that the ribs 310 function as a roughened surface that provides increased friction between the clip 10 and the clip holder 300.

In yet another aspect, the clip holder 300 includes a feature that limits the end-to-end sliding action of the clip 10 when it is securely fastened to the clip holder 300. End-to-end sliding action refers to movement of the clip 10 from an upper end 123 of the platform 120 to a lower end 125 or vice versa. Since the projections 16 only lock the clip 10 in the forward-rearward direction, the clip 10 is permitted to move in a direction perpendicular to this direction (namely an up-down direction). Since it is desirable for the clip 10 to remain positioned on the platform 120, a pair of opposing locating projections (nubs) or posts 320 are formed on each side of the web 102.

The posts 320 are integrally formed with the web 102 and are located adjacent the platform 120 at the rear section thereof. The cross-sectional shape of the post 320 can vary depending upon design choice among other things since the posts 320 merely provide a stop or interference surface that restricts the up and down movement of the clip 10 on the platform 120. In one embodiment, the posts 320 are in the form of upper and lower transverse posts with one post 320 being formed along the upper end 123 of the platform 120 and the other post 320 being formed along the lower end 125 of the platform 120. Each of the illustrated posts 320 has an oblong or elongated configuration and includes a first end 322 and an opposing second end 324. The first end 322 of the post 320 is located near or at the innermost edge of the platform 120, while the opposite second end 324 is located along the platform 120 and terminates at a point prior to the forward section of the platform 120 where the platform 120 and ramp 130 merge.

The posts 320 should be located along the web 102 and relative to the platform 120 and have a length such that at least the leading edges 20 of the clip 10 are disposed between and adjacent the posts 320 when the clip 10 is securely attached to the clip holder 300. In other words, when the clip 10 is securely attached to the clip holder 300, the posts 320 obstruct side access to the leading edges 20 of the clip 10 and this further prevents someone from tying to pry the clip 10 from the clip holder 300 by lifting of the clip 10 from the clip holder 300. The posts 320 are thus yet another safety feature that prevents the clip 10 from being easily removed from the clip holder 300. While the posts 320 are illustrated at one end of the platform 120, it will be appreciated that the posts 320 do not have to be formed as part of the web 102 such that they are at one end of the platform 120 but rather the posts 320 can be formed so that they are formed intermediate the ends of the platform 120.

It will be understood that while the posts 320 are shown in FIGS. 5 and 6 as being generally rectangular shaped members, the posts 320 can have any number of different shapes, such as oblong, square or even circular. Preferably, the upper and lower transverse posts 320 have a length that is less than 50% the width of the clip 10 so that when the clip 10 is engaged to the clip holder 300, only a portion of the ends of the clip 10 are covered by the posts 320. Moreover, it is preferred that the portion of the ends of the clip 10 that are covered by the posts 320 includes the leading edge 20 so that the posts 320 effectively inhibit access thereto.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different claims set forth below may be combined in various ways in further accordance with the present invention.

What is claimed is:

1. A garment hanger in combination with an information clip having a closed end and first and second side walls with free ends, each side wall having an inwardly extending projection adjacent to but spaced from the closed end, the hanger including a body and a clip holder integral with the body, the clip holder having an enlarged region adapted to engage the inwardly extending clip side wall projections to inhibit removal of the clip from the clip holder;

the side wall projections being resiliently retained in engagement with the clip holder enlarged region; and the clip holder including a platform formed adjacent the enlarged region, the platform having a forward edge proximate the enlarged region and a rear edge, the platform being formed at a location such that the free clip ends seat on the platform proximate the rear edge so as to prevent separation of the side walls when the clip is mounted on the clip holder to retain the projections in engagement with the clip holder enlarged region, the clip holder having a first cross-sectional thickness in the platform region as measured between a first side of the clip holder and an opposite second side thereof, the first thickness being greater than a cross-sectional thickness of the clip holder in surrounding clip holder portions adjacent and including the forward and rear edges, as measured between the first and second sides.

2. The combination of claim 1, wherein the enlarged region comprises a front locking ridge that is adjacent a free edge of the hanger body.

3. The combination of claim 1, wherein the platform is a planar member.

4. The combination of claim 1, wherein the altering means comprises a plurality of longitudinal ribs that run the length of the platform and are parallel to one another.

5. The combination of claim 4, wherein the longitudinal ribs are spaced apart such that a leading edge of the clip can be received between next adjacent ribs.

6. The combination of claim 1, wherein the clip holder has a free leading edge adjacent the enlarged region that includes a recessed section where the enlarged region of the clip holder is formed.

7. The combination of claim 6, wherein the recessed section is recessed relative to a free edge of the body of the hanger on which the clip holder is formed such that a shoulder is formed between the leading edge of the clip holder and the free edge of the body.

8. The combination of claim 6, wherein a length of the recessed section is about equal to or slightly greater than a length of the closed end of the clip so as to permit the clip to be inserted therein and mated with the enlarged section.

9. The combination of claim 1, further including:

means formed along a free edge of the body of the hanger for restricting access from the sides to the closed end of the clip when the clip is securely attached to the clip holder.

10. The combination of claim 1, further including:

a pair of obstructions formed along the ends of the platform such that when the clip is attached to the clip holder, the obstructions restrict side access to the leading edges of the clip that sit on the platform.

11. The combination of claim 10, wherein the obstructions are in the form of a pair of posts that are formed near or at the rear edge of the platform.

12. The combination of claim 10, wherein each obstruction covers less than 50% of a length of an end of the clip.

13. The combination of claim 10, wherein a height of each obstruction is greater than a height of the platform, as measured from the hanger body.

14. The combination of claim 10, wherein the obstruction extends along less than 75% of a length of the ends of the platform.

15. A garment hanger in combination with an information clip having a closed end and first and second side walls with free ends, each side wall having an inwardly extending projection adjacent to but spaced from the closed end, the hanger including a body and a clip holder integral with the body, the clip holder having an enlarged region adapted to engage the inwardly extending clip side wall projections to inhibit removal of the clip from the clip holder;

the side wall projections being resiliently retained in engagement with the clip holder enlarged region;

the clip holder including a platform formed adjacent the enlarged region, the platform having a forward edge proximate the enlarged region and a rear edge, the platform being formed at a location such that the free clip ends seat on the platform proximate the rear edge so as to prevent separation of the side walls when the clip is mounted on the clip holder to retain the projections in engagement with the clip holder enlarged region;

the clip holder including means for altering the surface characteristics of the platform to assist in locating and retaining the free ends on the platform; and an inclined ramp formed between the enlarged region and the platform, wherein when the projections are in engagement with the clip holder enlarged region, the projection of one side wall is disposed above the ramp.

16. A garment hanger in combination with an information clip having a closed end and first and second side walls with free ends, each side wall having an inwardly extending projection adjacent to but spaced from the closed end, the hanger including a body having a hook member joined to the body at one end thereof, and a clip holder;

the clip holder comprising a web integral with the body and having a free edge and a securing ridge adapted to engage the inwardly extending clip side wall projections to inhibit removal of the clip from the clip holder, the securing ridge being spaced from the free edge;

the side wall projections being resiliently retained in engagement with the clip holder securing ridge;

the clip holder including a platform formed adjacent the securing ridge, the platform having a forward edge proximate the securing ridge and a rear edge, the platform being formed at a location such that the free clip ends seat on the platform proximate the rear edge so as to prevent separation of the side walls when the clip is mounted on the clip holder to retain the projections in engagement with the clip holder securing ridge; and an inclined ramp formed between the platform and the securing ridge that defines, along with the securing ridge, a space in which the projection is retained.

17. The combination of claim 16, further including:

first means formed along the free edge of the web for restricting side access to the end wall of the clip when the clip is securely attached to the clip holder; and second means disposed along ends of the platforms for restricting side access to the free ends of the clip.

18. The combination of claim 17, wherein the first means comprises a notch formed along the free edge of the web, the notch having a length that is at least a length of the end wall of the clip so as to permit the clip to be inserted therein and mated with the enlarged section so as to permit the clip to be inserted therein and mated with the enlarged section.

19. The combination of claim 17, wherein the second means comprises a pair of posts that are formed along ends of the platform.

20. The combination of claim 17, wherein a top surface of the platform includes a plurality of surface altering features formed as part thereof and are parallel to one another.

21. The combination of claim 20, wherein the surface altering features comprise a plurality of longitudinal ribs that are formed along the surface.

22. The combination of claim 20, wherein the longitudinal ribs are spaced apart such that the leading edge of the clip can be received between next adjacent ribs.

23. A garment hanger in combination with an information clip having a closed end and first and second side walls with free ends, each side wall having an inwardly extending projection adjacent to but spaced from the closed end, the hanger including a body and a clip holder integral with the body, the clip holder having an enlarged region adapted to engage the inwardly extending clip side wall projections to inhibit removal of the clip from the clip holder;

the side wall projections being resiliently retained in engagement with the clip holder enlarged region;

the clip holder including a platform formed adjacent the enlarged region, the platform having a forward edge proximate the enlarged region and a rear edge, the platform being formed at a location such that the free clip ends seat on the platform proximate the rear edge so as to prevent separation of the side walls when the clip is mounted on the clip holder to retain the projections in engagement with the clip holder enlarged region; and wherein a cross-sectional thickness of the platform is greater than a cross-sectional thickness of a web portion of the clip holder that is integral with the hanger body and abuts the rear edge of the platform.

* * * * *